US007927008B2

(12) United States Patent
Colpo et al.

(10) Patent No.: US 7,927,008 B2
(45) Date of Patent: Apr. 19, 2011

(54) DETENT ESCAPEMENT

(75) Inventors: Fabiano Colpo, Lausanne (CH); Benoit Boulenguiez, Annemasse (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 12/635,264

(22) Filed: Dec. 10, 2009

(65) Prior Publication Data

US 2010/0149926 A1 Jun. 17, 2010

(30) Foreign Application Priority Data

Dec. 16, 2008 (EP) ..... 08405306
Feb. 16, 2009 (EP) ..... 09405029

(51) Int. Cl.
*G04B 15/00* (2006.01)

(52) U.S. Cl. ..... 368/127

(58) Field of Classification Search ..... 368/124, 368/127–131, 169
See application file for complete search history.

(56) References Cited

U.S. PATENT DOCUMENTS 6,301,981 B1 * 10/2001 Oechslin ..... 74/1.5
6,942,378 B2 * 9/2005 Hayek et al. ..... 368/127
7,097,350 B1 * 8/2006 Conus et al. ..... 368/127
7,458,717 B2 * 12/2008 Baumberger et al. ..... 368/127
7,604,395 B2 * 10/2009 Cabezas Jurin et al. ..... 368/127
7,607,822 B2 * 10/2009 Cabezas Jurin et al. ..... 368/127
7,708,455 B2 * 5/2010 Cabezas Jurin et al. ..... 368/131
2005/0122847 A1 6/2005 Hayek et al.

FOREIGN PATENT DOCUMENTS

EP 1538490 A1 6/2005

OTHER PUBLICATIONS

European Search Report dated Aug. 14, 2009, issued in corresponding European Patent Application No. 09405029.

* cited by examiner

*Primary Examiner* — Vit W Miska
(74) *Attorney, Agent, or Firm* — Westerman, Hattori, Daniels & Adrian, LLP

(57) ABSTRACT

This escapement comprises a balance wheel fastened to an impulse element (7*a*), an escape wheel (1), a detent swing-arm (2) having a stop element (2*a*) and a disengagement element (2*b*), a disengagement finger (11*d*), constrained to rotate with the balance wheel, to come into engagement with the disengagement element (2*b*) of the detent swing-arm (2) once per oscillation period of the balance wheel. The disengagement finger (11*d*) is fastened to an inertial member (11) mounted to move freely between two extreme positions in one of which the trajectory of the disengagement finger (11*d*) passes through the disengagement element (2*b*) of the swing-arm (2) and in the other of which this trajectory does not pass through this disengagement element (11*b*), the passage of the inertial member (11) from one position to the other resulting from the inertia force caused by the variations of speed of the balance wheel in each alternation of oscillation of the balance wheel.

8 Claims, 5 Drawing Sheets

DETENT ESCAPEMENT

The present invention relates to a detent escapement for a timepiece comprising a balance wheel fastened to an impulse element, an escape wheel the teeth whereof intersect the trajectory of the impulse element, a detent swing-arm having a stop element and a disengagement element, means for engaging the stop element in the trajectory of the teeth of the escape wheel, and a disengagement finger or pallet constrained to rotate with the balance wheel, to come into engagement with the disengagement element of the swing-arm once per oscillation period of the balance wheel to disengage the stop element from the teeth of the escape wheel.

Because the detent escapement does not use an anchor between the escape wheel and the balance wheel, the impulse of the escape wheel on the impulse finger of the balance wheel can be produced in only one direction of rotation of the balance wheel, either once per period of oscillation or in one alternation in two, an alternation corresponding to an oscillation half-period.

This type of escapement necessitates a disengagement swing-arm that includes on the one hand a stop element that intersects the trajectory of the teeth of the escape wheel and on the other hand a disengagement element with which a disengagement finger fastened to the balance wheel engages. This disengagement finger must not engage with the disengagement element except during the alternation in which the balance wheel receives an impulse from the escape wheel, the stop element having to remain engaged with the escape wheel during the other alternation.

In standard detent escapements, the disengagement swing-arm includes a leaf spring the free end of which presses against an abutment of the swing-arm so that the blade drives the swing-arm in one direction of rotation of the disengagement finger of the balance wheel while in the opposite rotation direction the leaf spring flexes and allows the disengagement finger to pass without driving the disengagement swing-arm. This prevents the escape wheel turning without transmitting an impulse to the balance wheel during one of the two alternations, as in the Robin escapement, which causes a loss of energy and therefore a reduction of efficiency.

The dimensions of the flexible parts of the detent is clearly one of the points critical to the development of this escapement. Sufficient rigidity is required to retain the abutment in its natural position but, at the same time, the energy to release the escape wheel or to effect the detent function must not be too high, the risk being non-negligible disturbance of the oscillatory mechanism consisting of the balance wheel and the spiral spring, associated with a substantial drop in efficiency, and even stopping of the system. Moreover, the unlocking torque necessary to release the escape wheel also represents an operational safety feature (shock protection) that imposes a lower limit on the stiffness of the leaf spring.

This mechanism has mainly been employed in marine chronometers; it is delicate, demands perfect execution and hardly lends itself to mass production. It is fragile and cannot withstand the loads to which wristwatches are subjected when worn. It is also an excellent escapement that enables very precise adjustment and consequently the highest possible chronometric performance.

EP 1 538 490 proposes to solve the problem of the leaf spring by fastening it to the balance wheel instead of to the disengagement swing-arm. The spring then takes the form of a spiral spring the free end of which terminates in a finger having a radial driving face and an inclined disengagement face designed to cause the spiral spring to flex so that the finger entrains the detent swing-arm in only one direction of rotation of the balance wheel.

Although of interest, this solution still makes it necessary to overcome the force of the spiral spring to move the finger away if the detent swing-arm is not to release the escape wheel, generating interference with the period of the balance wheel+spiral spring assembly and a loss of energy.

The object of the present invention is to remedy at least in part the drawbacks referred to above.

To this end, this invention consists in a detent escapement according to claim 1 for a timepiece.

This feature makes it possible to use the inertia of a member subjected to the oscillatory movement of the balance wheel to actuate the disengagement finger of the balance wheel as a function of its rotation direction, so that in one rotation direction the trajectory of the disengagement finger passes through the disengagement element of the swing-arm and in the opposite rotation direction this trajectory passes outside that disengagement element.

Thus in this detent escapement the disengagement finger no longer has to overcome a spring force. Because of this, it therefore uses no energy to move away an elastic member and does not cause any disturbance to the period of oscillation of the balance wheel, since the disengagement finger is moved away from the disengagement element of the detent swing-arm during the alternation in which the escape wheel is not disengaged by the swing-arm and consequently does not transmit any impulse to the balance wheel.

The operation of this escapement is not subject to some of the risks encountered with standard detent escapements. The consequences of a shock moving the inertial member into its other extreme position will not be a problem. In one case, the disengagement finger will encounter the disengagement element instead of being retracted and will move the inertial member into its correct position with negligible force. In the other case, instead of engaging with the disengagement element, the finger will not encounter it, which will cause the loss of one impulse on the balance wheel and one increment of the gear train, this having no impact on the correct operation of the watch because it is at most an extremely rare event.

Furthermore, the operation of this escapement reduces some of the risks associated with the use of standard detent escapements. A shock applied to the timepiece can lead to its balance wheel turning farther than through a normal operating angle, which leads during the alternation in which the pulse is produced to the gear train being released again. This results in galloping, because two disengagements and two impulses occur during the same alternation. The system of the invention is not subject to the standard problem because the disengagement finger is at this time already withdrawn from the trajectory of the unlocking element and does not cause movement of the locking element and therefore does not provoke a second impulse.

Other features and advantages of the invention will become apparent in the course of the following description given with reference to the appended drawings which show diagrammatically and by way of example one embodiment of the detent escapement of the invention.

FIGS. 2 to 7 show the detent escapement without the balance wheel, showing only the impulse and release device constrained to rotate with the pivot shaft of the balance wheel. For clarity, the balance wheel B is shown only in FIG. 1.

The detent escapement includes an escape wheel 1 connected to a barrel spring (not shown) by a finishing gear train (not shown) that causes the escape wheel 1 (FIGS. 1 to 7) to turn in the anticlockwise direction.

Figure 1:
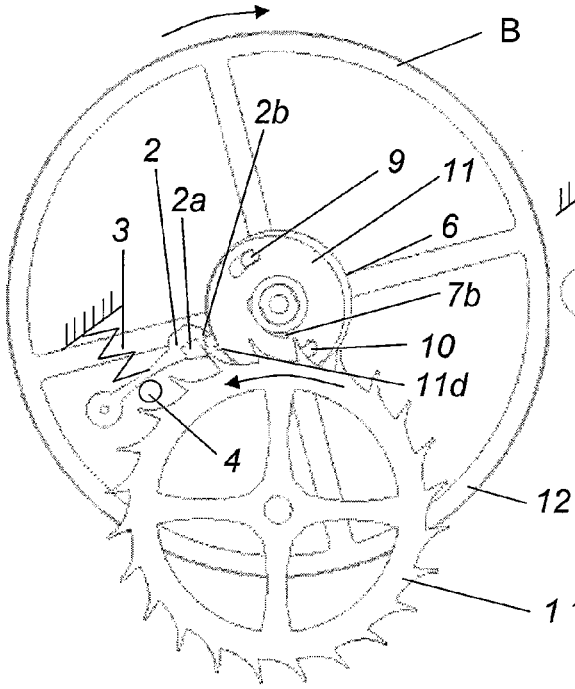
FIGS. 1 to 7 show this detent escapement in different positions during one period of oscillation of the balance wheel.

In the position shown in FIG. 1, one tooth of the escape wheel 3 is bearing against a stop element 2*a*, advantageously formed by a pallet ruby, of a disengagement swing-arm 2. This disengagement swing-arm 2 is loaded by a spring 3 that urges it against an abutment 4, in which position the stop pallet 2*a* is engaged in the trajectory of the teeth of the escape wheel so that one tooth of that wheel bears against the stop pallet 2*a* as shown in FIG. 1.

Figure 8:
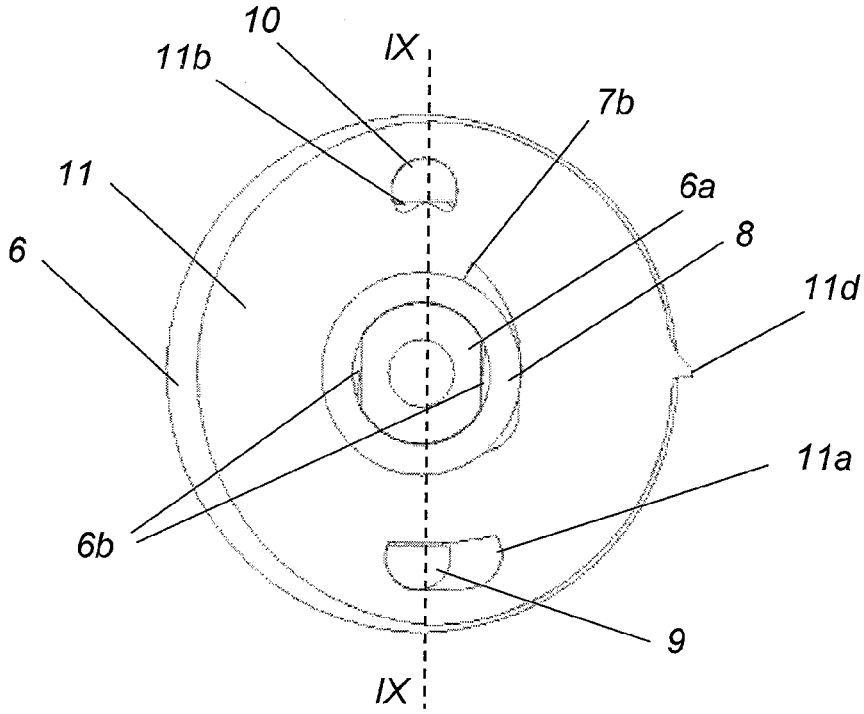
FIG. 8 is a partial view from beneath of FIG. 1.
Figure 9:
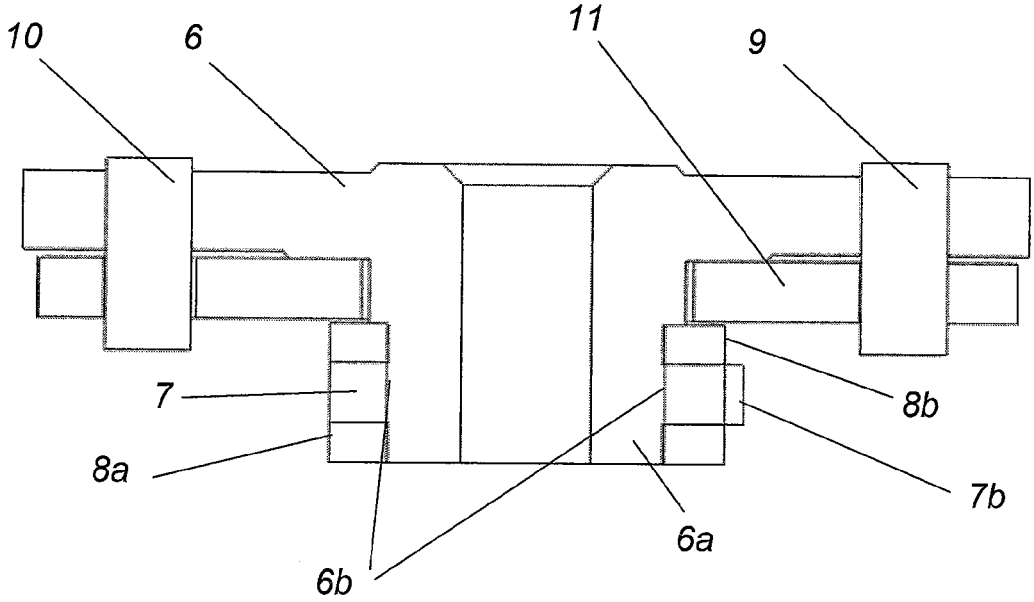
FIG. 9 is a view in section taken along the line IX-IX in FIG. 8.
Figure 10:
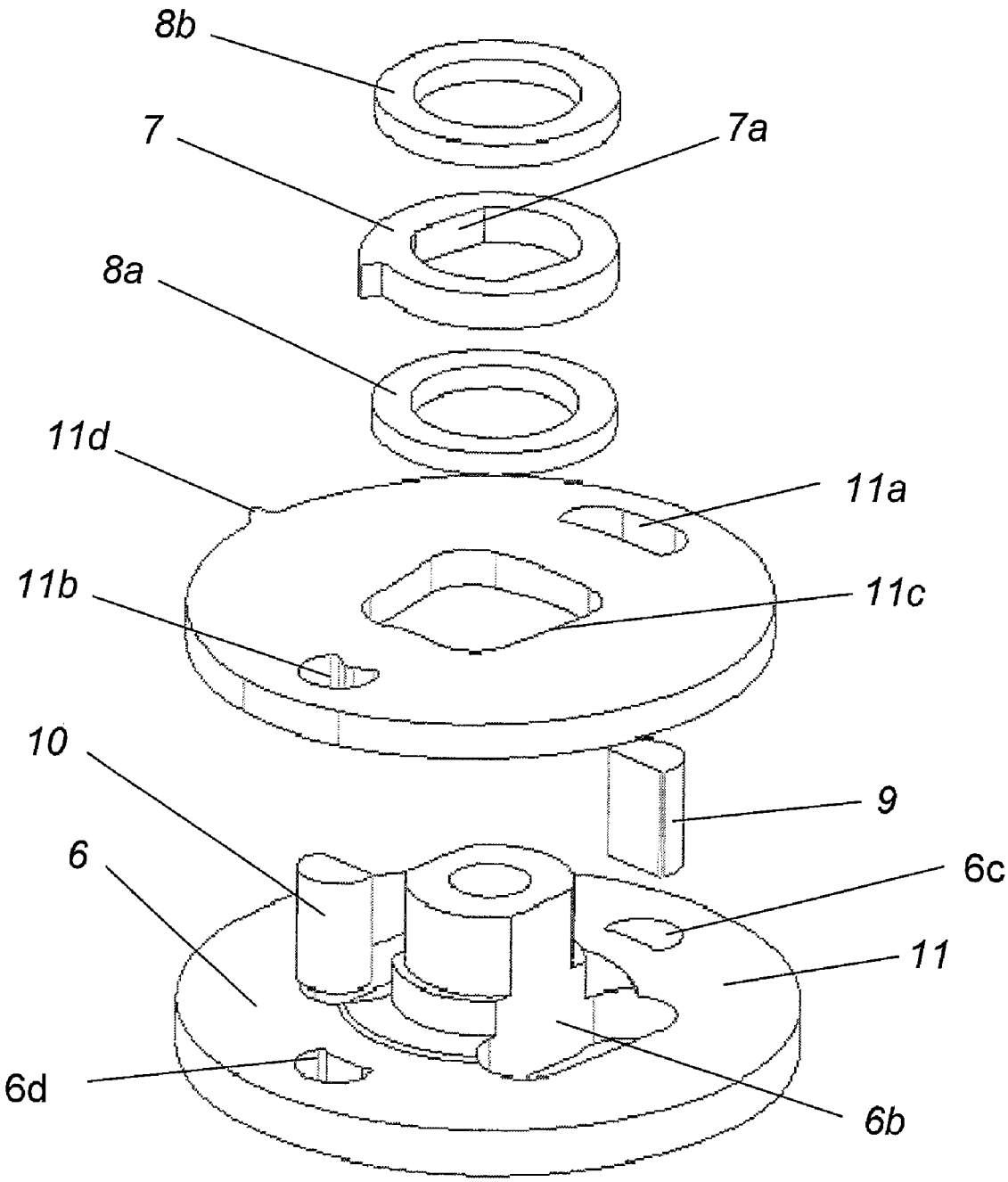
FIG. 10 is an exploded view of the part shown in FIG. 9.

The impulse and disengagement device associated with the pivot shaft of the balance wheel is shown in detail in FIGS. 8 to 10. It includes a circular plate 6 with a tubular element 6*a* designed to fit onto the shaft of the balance wheel. This tubular element 6*a* has a circular external section intersected by two plane external parallel faces 6*b* (FIG. 8) on which is engaged an impulse ring 7 including an opening 7*a* (FIG. 10) with a section complementary to that of the external section of the tubular element 6*a*. The impulse wheel 7 is retained axially between two fitted retaining rings 8*a*, 8*b*.

The impulse ring 7 has an impulse finger or face 7*b* projecting from the external lateral face of the impulse ring 7. The finger of the impulse ring can be an attached element such as a pallet.

Two pins 9 and 10, of semi-circular section in this example, are fitted into respective diametrally opposed holes 6*c*, 6*d* in the plate 6.

An inertial member 11 of elliptical shape in this example is provided with three openings 11*a*, 11*b*, 11*c*, two openings 11*a*, 11*b* of which are eccentric and preferably symmetrical and diametrally opposed. One of these openings 11*b* is semi-circular, delimited by two radii at an angle greater than 180° to receive the pivot pin 10 of the inertial member 11 and enabling angular movement thereof. The other opening 11*a* is elongate to receive the pin 9. The third opening is a central opening 11*c* through which the tubular part 6*a* of the plate 6 passes with clearance and, in the absence of the opening 11*a* and the pin 9, can serve to limit the angular displacement of the inertial member 11. A disengagement finger 11*d* projects from the lateral external face of the inertial member 11. This disengagement finger 11*d* is of triangular shape in this example, with a drive face oriented radially relative to the centre of the inertial member 11 and an inclined face, as shown in FIG. 8. The disengagement finger could also be formed by an attached pallet ruby, like the finger 7*b*. The inclined face of the disengagement finger 11*d* serves to push back the inertial element 6 if a shock should move it to the projecting position when it should be in a retracted position.

As shown in FIG. 9, the inertial member 11 is at the base of the tubular part 6*a*. As seen in FIG. 10, the openings 11*a*, 11*b*, 11*c* are disposed, sized and shaped to enable the inertial member 11 to effect a limited angular movement about the axis of the pin 10, which is parallel to the axis of the plate 6 fitted onto the pivot pin of the balance wheel and constitutes the pivot member of the inertial member 11. The elongate opening 11*a* extends symmetrically with respect to a diameter of the inertial element 11 passing through the respective axes of the openings 11*b*, 11*c* so that the two limit positions of the inertial member 11 are situated symmetrically on either side of the pivot axis of the balance wheel.

To minimize the impact on the equilibrium of the balance wheel, the axes of the two openings 11*a*, 11*b* occupy symmetrical and diametrally opposite positions relative to the centre of the inertial member 11. The pins 9, 10 occupy corresponding and symmetrical diametrally opposite positions relative to the center of the circular plate 6 in order to cooperate with the respective openings 11*a*, 11*b*.

Figure 2:
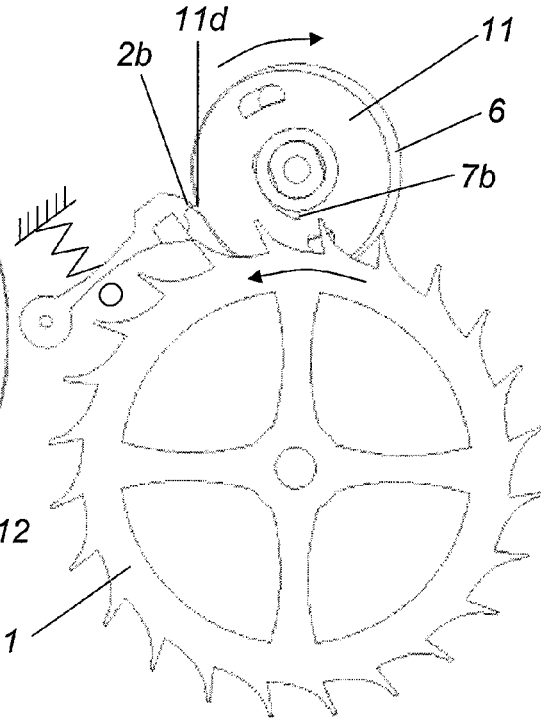

In FIG. 1, the angular position occupied by the inertial member 11 corresponds to that in which the disengagement finger 11*d* projects to the outside of the periphery of the circular plate 6. On turning clockwise, the radial face of the triangular finger encounters a disengagement element 2*b* situated at the free end of the disengagement swing-arm 2, with the result that the disengagement finger 11*d* lifts the disengagement swing-arm 2 against the pressure of the return spring 3, as shown in FIG. 2.

Figure 3:
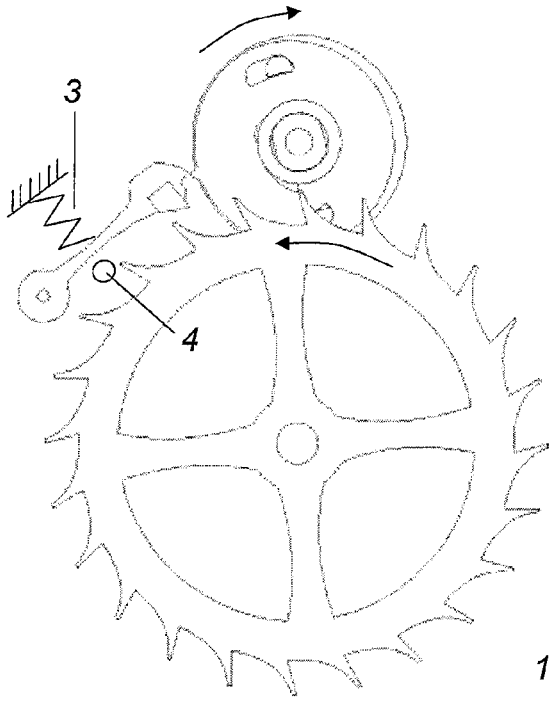

As soon as the escape wheel 1, tensioned by the barrel spring via the finishing gear train, is released, it is driven in the anticlockwise direction with the result that a tooth of the escape wheel 1 encounters the impulse finger 7*b*, transmitting force from the barrel spring directly to the balance wheel, as shown in FIG. 3.

Figure 4:
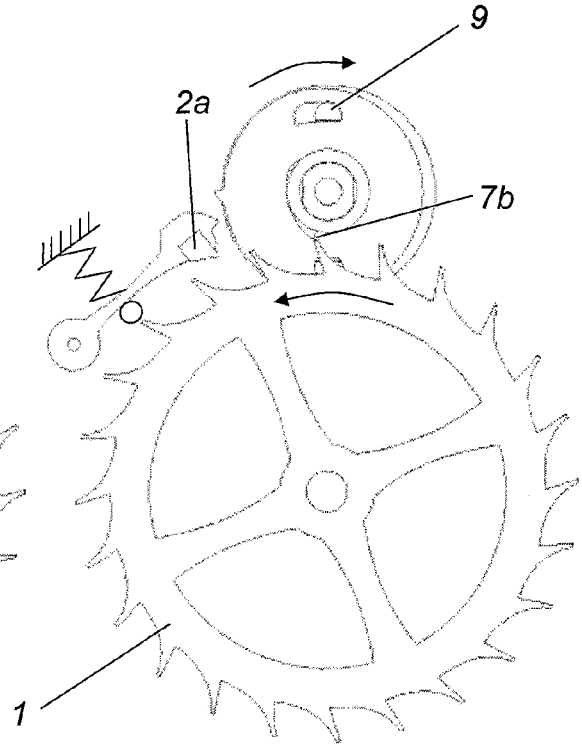
Figure 5:
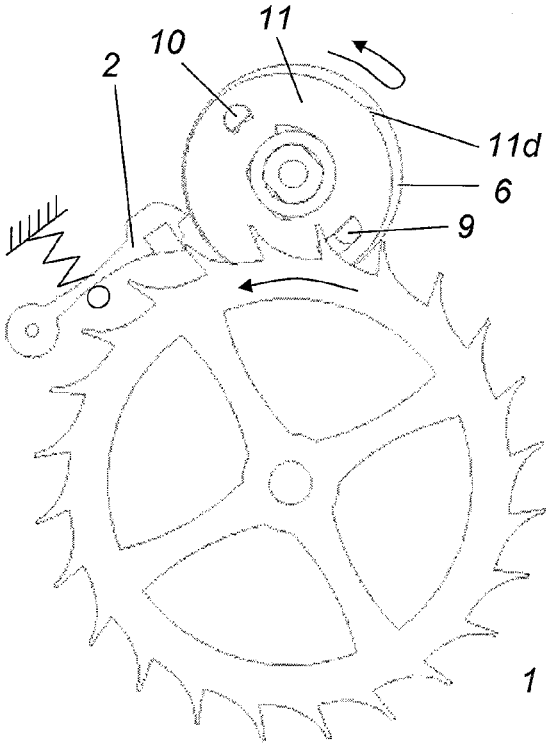

FIG. 4 shows the spring 3 returning the disengagement swing-arm 2 to the position against the abutment 4 after the swing-arm is released by the disengagement finger 11*d*, with the result that when the tooth of the escape wheel is released by the impulse finger 7*b*, another tooth of the escape wheel is stopped by the pallet 2*a* of the disengagement swing-arm 2, as shown in FIG. 5.

FIG. 5 also shows reversing of the direction of rotation of the balance wheel from the clockwise direction to the opposite direction. The shaft of the balance wheel is constrained to rotate with the impulse finger 7*b* and the disengagement finger 11*d*. The balance wheel is decelerated by the spiral spring and its speed passes through zero before it is driven in rotation in the opposite direction.

The inertial member 11 has two stable positions depending on the rotation direction of the balance wheel. Trials have shown that the inertial member 11 moves before the balance wheel has completed each of the two alternations constituting its oscillation period but its rotation about the pin 10 begins in the vicinity of the dead point of the balance wheel (angle 0 of its position).

At the dead point, the balance wheel has the maximum speed and therefore goes from positive acceleration to negative acceleration (it begins to decelerate) and it is at this time that the inertia effects begin to make themselves felt.

This behavior depends on the inertia of the inertial member 11 (in particular its material and geometry) and friction between the inertial member 11 and the surfaces with which it is in contact, and is also influenced by the effect of the centrifugal force that acts on the center of mass of the inertial member 11 (which is offset relative to the rotation axis of the balance wheel) and is added to the initial acceleration caused by the balance wheel.

In the phase illustrated in FIG. 5, the inertial member 11 has moved clockwise around the axis of the pin 10. In this position, the disengagement finger 11*d* is retracted inside the peripheral edge of the circular plate 6.

Figure 6:
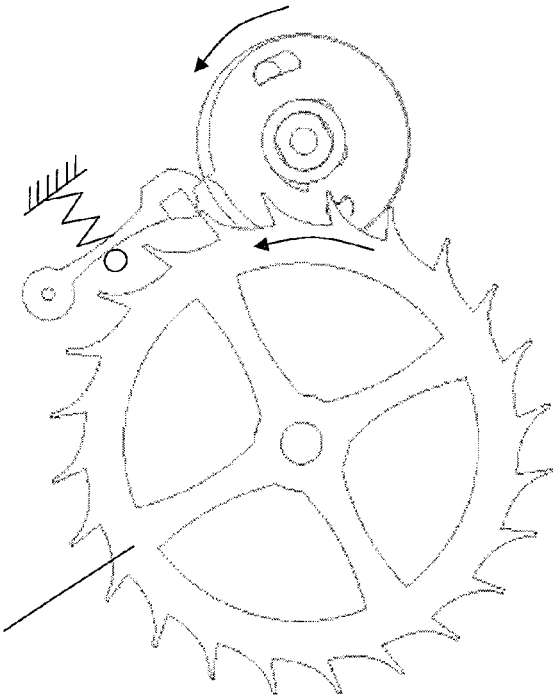
Figure 7:
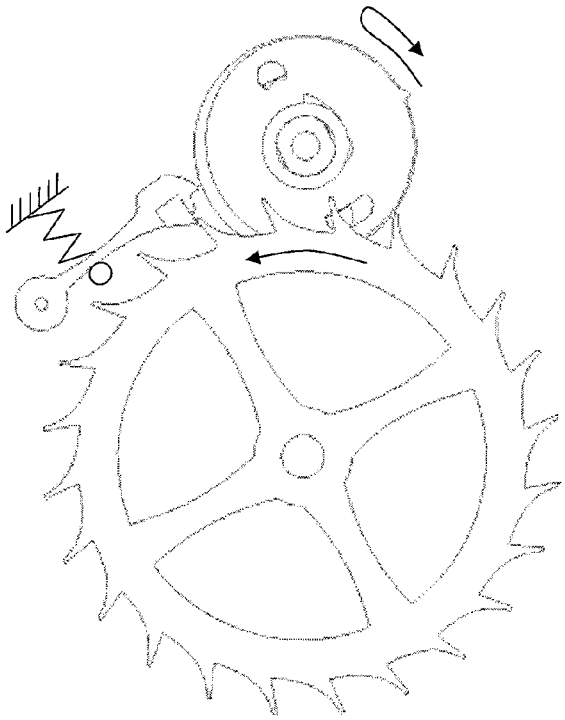

Consequently, the disengagement finger 11*d* does not cooperate with the disengagement swing-arm 2 when it passes in front of the disengagement element 2*b*, as shown in FIG. 6. In contrast to all known direct impulse transmission escapements, the disengagement finger 11*d* has no elastic member to overcome to get past the obstacle of the element 2*b* of the detent swing-arm 2 during the alternation of the balance wheel in which the latter receives no impulse to sustain its oscillatory movement since the finger is retracted inside the circular periphery of the plate 6. There is therefore no loss of energy and no disturbance to the period of oscillation of the balance wheel.

When the balance wheel B arrives at the end of its rotation in the anticlockwise direction (FIG. 7), its deceleration again causes the inertial member 6 to move back into the position in which the disengagement finger 11*d* projects outside the circular periphery of the plate 6.

Figure 11:
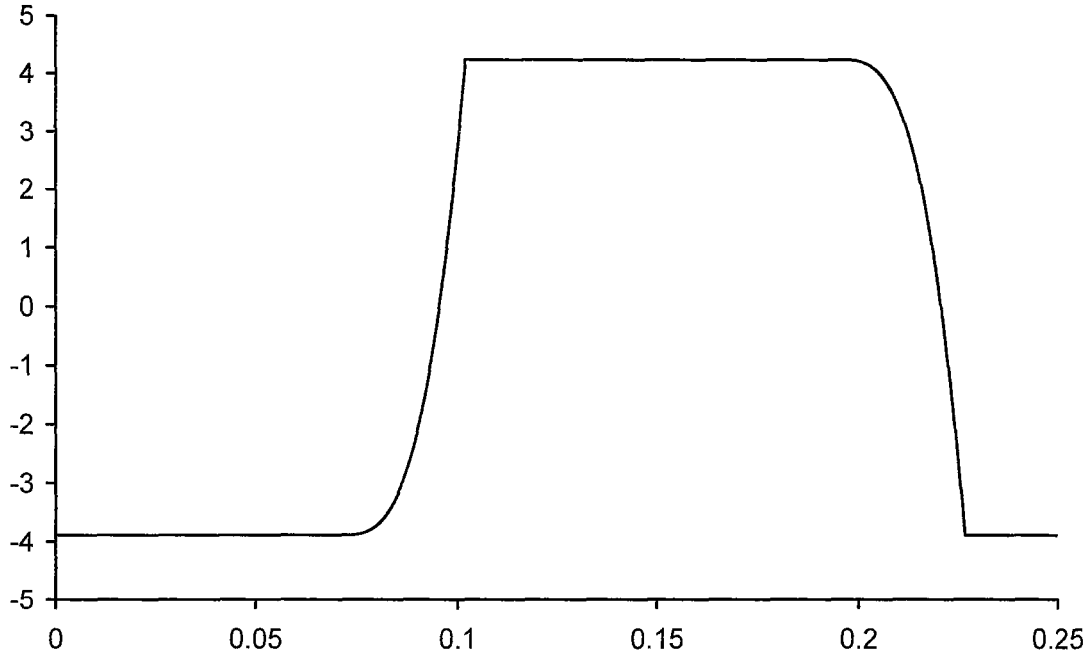
FIG. 11 is a diagram of the angular movement of the inertial element during the period of oscillation of the balance wheel, with time in seconds plotted on the abscissa axis and angle in degrees plotted on the ordinate axis.
Figure 12:
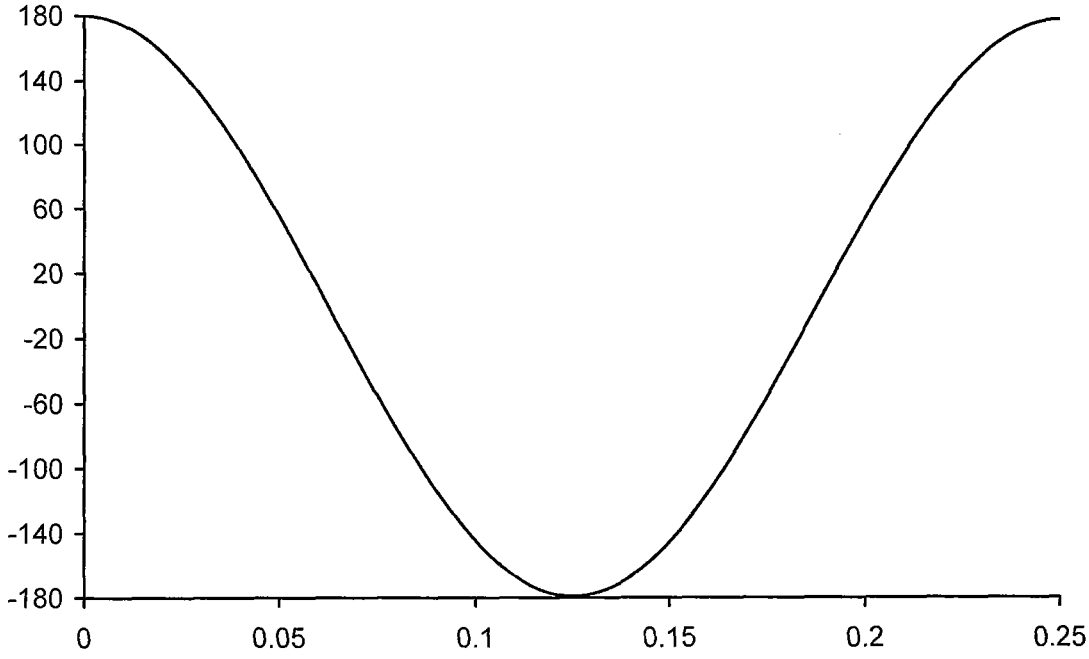
FIG. 12 is a diagram of the angular displacement of the balance wheel over one period of oscillation, with time in seconds plotted on the abscissa axis and angle in degrees plotted on the ordinate axis.

FIG. 11 is a diagram of the angular displacement of the balance wheel during one period of oscillation. It should be compared with the FIG. 12 diagram which shows the angle of displacement of the inertial member 11 between its two limit positions determined by the two radial edges of the opening 11*a* abutting alternately against the pin 9 fastened to the plate 6.

The angular movement of the inertial member 11 between its two limit positions is only a few degrees, typically of the order of 5° to 10°, these two limit positions being situated symmetrically on either side of the pivot axis of the balance wheel. This inertial member 11 can be produced in a material of low specific mass, the inertia effect still being sufficient to guarantee its function. The freedom of choice as to the exterior geometrical shape means that an inertia element can be produced of symmetrical shape, which guarantees a low added out-of-balance. Experience shows that with a material of relatively low density such as silicon the influence on the equilibrium of the balance wheel is negligible.

The LIGA technique can be used to produce a thin nickel inertial member 11, typically of the order of 0.10 to 0.15 mm thick, so that the influence on the equilibrium of the balance wheel can be considered negligible.

The invention claimed is:

1. A detent escapement for a timepiece comprising a balance wheel fastened to an impulse element, an escape wheel the teeth whereof intersect the trajectory of the impulse element, a detent swing-arm having a stop element and a disengagement element, means for engaging the stop element in the trajectory of the teeth of the escape wheel, and a disengagement finger, constrained to rotate with the balance wheel, to come into engagement with the disengagement element of the detent swing-arm once per oscillation period of the balance wheel to release the stop element from the teeth of the escape wheel, wherein the disengagement finger is fastened to an inertial member mounted to move freely between two extreme positions in one of which the trajectory of the disengagement finger passes through the disengagement element of the swing-arm and in the other of which this trajectory does not pass through this disengagement element, the passage of the inertial member from one position to the other resulting from the inertia force acting on the inertial member caused by the variations of speed of the balance wheel in each half-cycle of oscillation of the balance wheel.

2. The detent escapement as claimed in claim 1, wherein the inertial member is an element mounted on a plate fastened to the pivot shaft of the balance wheel via a pivot member about an axis parallel to the pivot axis of the balance wheel and eccentric relative to the center of said element that is provided with an opening for the pivot shaft of the balance wheel to pass through with clearance, the two limit positions of the inertial member being situated symmetrically on either side of the pivot axis of the balance wheel.

3. The escapement as claimed in claim 2, wherein one member of the pair of members comprising the plate and the element of the inertial member carries two pins, respectively a pivot pin and a pin for limiting the angular movement, occupying diametrically opposed and symmetrical positions, while the other member of said pair has two openings the axes of which occupy homologous diametrally opposite and symmetrical positions intended to receive the respective pins, the element of the inertial member including a central opening allowing the passage with clearance of a tubular element adapted to be fitted onto the shaft of the balance wheel, fastened to the plate.

4. The escapement as claimed in claim 3, wherein said tubular element adapted to be fitted onto the balance wheel shaft has a part-circular external section on which a ring provided with said impulse element is engaged, the section of the opening of this ring being complementary to the external section of the tubular element, this ring being retained axially on the tubular element by a retaining ring.

5. The escapement as claimed in claim 1, wherein the means for engaging the stop element in the trajectory of the teeth of the escape wheel are spring return means.

6. The escapement as claimed in claim 2, wherein the means for engaging the stop element in the trajectory of the teeth of the escape wheel are spring return means.

7. The escapement as claimed in claim 3, wherein the means for engaging the stop element in the trajectory of the teeth of the escape wheel are spring return means.

8. The escapement as claimed in claim 4, wherein the means for engaging the stop element in the trajectory of the teeth of the escape wheel are spring return means.

* * * * *